US009243798B2

(12) United States Patent
Schlueter

(10) Patent No.: US 9,243,798 B2
(45) Date of Patent: Jan. 26, 2016

(54) ILLUMINATION SYSTEM

(71) Applicant: Schluter Systems L.P., Plattsburgh, NY (US)

(72) Inventor: Werner Schlueter, Iserlohn (DE)

(73) Assignee: Schluter Systems L.P., Plattsburgh, NY (US)

( * ) Notice: Subject to any disclaimer, the term of this patent is extended or adjusted under 35 U.S.C. 154(b) by 83 days.

(21) Appl. No.: 14/152,017

(22) Filed: Jan. 10, 2014

(65) Prior Publication Data

US 2014/0198489 A1 Jul. 17, 2014

(30) Foreign Application Priority Data

Jan. 11, 2013 (DE) ..... 20 2013 100 146 U

(51) Int. Cl.

| | |
|---|---|
| ***F21V 33/00*** | (2006.01) |
| ***F21V 3/04*** | (2006.01) |
| ***F21V 15/01*** | (2006.01) |
| ***F21V 17/16*** | (2006.01) |
| *E04F 11/104* | (2006.01) |
| *F21W 111/027* | (2006.01) |
| *F21Y 101/02* | (2006.01) |
| *F21Y 103/00* | (2006.01) |
| *E04F 11/16* | (2006.01) |

(52) U.S. Cl.

CPC ..... *F21V 33/006* (2013.01); *F21V 3/0445* (2013.01); *F21V 15/013* (2013.01); *F21V 17/164* (2013.01); *E04F 11/166* (2013.01); *E04F 2011/1048* (2013.01); *F21W 2111/027* (2013.01); *F21Y 2101/02* (2013.01); *F21Y 2103/003* (2013.01)

(58) Field of Classification Search

CPC ... H02G 3/0425; F21V 33/006; F21V 3/0445; F21V 15/013; F21V 17/164

See application file for complete search history.

(56) References Cited

U.S. PATENT DOCUMENTS

| | | | |
|---|---|---|---|
| 1,930,244 | A | 10/1933 | Lewinsohn et al. |
| 1,984,355 | A | 12/1934 | Abbott |

(Continued)

FOREIGN PATENT DOCUMENTS

| | | | |
|---|---|---|---|
| AT | 511 325 | A4 | 11/2012 |
| DE | 297 09 378 | U1 | 7/1997 |

(Continued)

OTHER PUBLICATIONS

German Search Report dated Dec. 19, 2013 in German Application No. 20 2013 100 141.4 with English translation of relevant parts.

(Continued)

*Primary Examiner* — Mary Ellen Bowman

(74) *Attorney, Agent, or Firm* — Collard & Roe, P.C.

(57) ABSTRACT

An illumination system for indirectly or directly illuminating an outer edge arrangement of a structure covered in tiles, such as for example a step of a staircase, includes at least one elongate profile that forms a base arm, a decorative arm projecting from a free end of the base arm and the outer surface of which forms a visible decorative surface in the correctly arranged state, and a fastening arm projecting from the other free end of the base arm, arranged opposite the decorative arm, at least one illuminant that is fastened or can be fastened within the receiving space defined by the base arm, the decorative arm and the fastening arm, and at least one elongate diffusion disc cover that can be fixed to the profile.

18 Claims, 1 Drawing Sheet

(56) References Cited

U.S. PATENT DOCUMENTS

| | | | | |
|---|---|---|---|---|
| 2,947,093 | A | 8/1960 | Masters | |
| 3,667,177 | A | 6/1972 | Biela | |
| 4,394,714 | A * | 7/1983 | Rote | 362/576 |
| 5,140,506 | A | 8/1992 | Katz | |
| 5,165,780 | A | 11/1992 | Katz | |
| 5,243,799 | A | 9/1993 | Schluter | |
| 5,336,849 | A * | 8/1994 | Whitney | 174/72 C |
| 5,514,834 | A | 5/1996 | Zimmerman | |
| 5,732,747 | A * | 3/1998 | Holliday | 138/163 |
| 5,775,016 | A * | 7/1998 | Chien | 40/544 |
| 6,345,480 | B1 | 2/2002 | Kemper et al. | |
| 6,401,418 | B1 | 6/2002 | Senn et al. | |
| 6,591,575 | B2 | 7/2003 | Benedettini | |
| 6,727,434 | B2 | 4/2004 | Jadaud et al. | |
| 6,745,534 | B2 * | 6/2004 | Kornfalt | 52/468 |
| 6,755,550 | B1 | 6/2004 | Lackey | |
| 6,911,597 | B2 | 6/2005 | Seamans et al. | |
| 6,972,637 | B2 | 12/2005 | Nation | |
| 6,990,776 | B2 | 1/2006 | Berman | |
| 7,060,893 | B1 | 6/2006 | Villi | |
| 7,388,163 | B2 | 6/2008 | VanderVelde et al. | |
| 8,197,105 | B2 | 6/2012 | Yang | |
| 2003/0029125 | A1 | 2/2003 | Salice | |
| 2005/0286247 | A1 | 12/2005 | Peterson | |
| 2006/0185295 | A1 | 8/2006 | Gardner | |
| 2007/0290475 | A1 * | 12/2007 | Reitinger | 280/164.1 |
| 2008/0066419 | A1 | 3/2008 | Stanchfield et al. | |
| 2011/0058353 | A1 | 3/2011 | Yang | |
| 2011/0183153 | A1 | 7/2011 | Schlueter | |

FOREIGN PATENT DOCUMENTS

| | | | |
|---|---|---|---|
| DE | 297 11 074 | U1 | 7/1998 |
| DE | 202 12 950 | U1 | 12/2003 |
| DE | 20 2007 011 342 | U1 | 11/2007 |
| DE | 20 2009 001 162 | U1 | 4/2009 |
| DE | 10 2008 056 958 | A1 | 5/2010 |
| DE | 20 2010 005 347 | U1 | 8/2010 |
| DE | 20 2011 104 306 | U1 | 10/2011 |
| FR | 2 803 367 | A1 | 7/2001 |
| WO | 2011/151272 | A1 | 12/2011 |
| WO | 2012/056029 | A1 | 5/2012 |

OTHER PUBLICATIONS

German Search Report dated Nov. 6, 2013 in German Application No. 20 2013 100 145.7 with English translation of relevant parts.

* cited by examiner

ILLUMINATION SYSTEM

CROSS REFERENCE TO RELATED APPLICATIONS

Applicant claims priority under 35 U.S.C. §119 of German Application No. 20 2013 100 146.5 filed Jan. 11, 2013, the disclosure of which is incorporated by reference.

BACKGROUND OF THE INVENTION

1. Field of the Invention

The present invention relates to an illumination system for indirectly or directly illuminating an outer edge arrangement of a structure covered in tiles, such as for example the outer edges of the steps of a staircase covered in tiles, the outer edges of a tiled landing, the outer edges of a tiled worktop or the like.

2. Description of the Related Art

Illumination systems of the type specified at the start are known in a wide range of configurations in the prior art. For example, for the indirect or direct illumination of the steps of a staircase LED strips can be stuck under floor tiles projecting from the treads.

SUMMARY OF THE INVENTION

On the basis of this prior art it is an object of the present invention to provide an alternative illumination system for the indirect or direct illumination of the steps of a staircase.

In order to achieve this object the present invention provides an illumination system of the type specified at the start comprising at least one elongate profile that forms a base arm, a decorative arm projecting from a free end of the base arm and the outer surface of which forms a visible decorative surface in the correctly arranged state, and a fastening arm projecting from the other free end of the base arm, arranged opposite the decorative arm, at least one illuminant that is fastened or can be fastened within the receiving space defined by the base arm, the decorative arm and the fastening arm, and at least one elongate diffusion disc cover that can be fixed to the profile.

One essential advantage of the illumination system according to the invention is that it can be integrated without any problem into the steps of a staircase while the tiles are being laid, a very attractive appearance being achieved.

According to one configuration of the present invention the profile is an extruded profile with a cross-section that remains the same over the entire length. It is an advantage of extruded profiles that they are easy and inexpensive to produce.

Preferably, the profile is produced from aluminium or stainless steel. Aluminium and stainless steel provide the profile on the one hand with a visually attractive appearance. On the other hand these materials are resistant to corrosion and correspondingly well suited for use in wet rooms, in outdoor areas or the like.

According to one version of the present invention the fastening arm is provided on its outside with at least one undercut recess. A pasty adhesive, such as for example a tile adhesive, used to fix the fastening arm to a substrate can penetrate into this type of undercut recess, by means of which anchoring and so fixing of the fastening arm onto the substrate can be brought about. Furthermore, a connection element can be positioned in the recess in order to connect adjacent profiles to one another.

According to another version a fleece or a fabric is fastened to the outside of the fastening arm, and said fleece or fabric serves as the adhesive base for an adhesive which can also be a tile adhesive or the like.

According to one configuration of the present invention at least one undercut recess is provided on the outside of the base arm. An adhesive for fixing the base arm can also anchor in this undercut recess. Furthermore, a connection element can be positioned in the recess so as to connect adjacent profiles to one another.

Alternatively, the base arm can also be provided with a fleece or fabric on its outside.

Preferably, a limiting arm projecting towards the decorative arm is provided on the free end of the fastening arm. This type of limiting arm serves first and foremost to limit tiles or slabs arranged next to one another.

According to one configuration of the present invention a holding arm projecting towards the base arm adjoins the limiting arm, said holding arm being positioned a distance away from the decorative arm. In this configuration the holding arm serves to fix the diffusion disc cover to the profile, as will be described in more detail below with reference to the exemplary embodiment.

The decorative arm and the fastening arm preferably extend parallel to one another and respectively at an angle of 90° in relation to the base arm. In this way a simple profile structure is achieved.

According to one configuration of the present invention the diffusion disc cover is substantially U-shaped and has a base section and two side sections projecting from the latter and lying opposite one another.

The first side section is preferably made longer than the second side section, in the correct state the illuminant being positioned on the inner surface of the first side section in the region protruding with respect to the second side section. This design is advantageous because due to the shorter second side section an illuminant can be positioned on the inside of the first side section, said illuminant then being easily accessible, by means of which the manageability of the illumination system is improved.

Preferably there is formed in the region of the free end of the first side section an inwardly projecting protrusion which serves as a stop for the illuminant. This stop facilitates correct positioning of the illuminant and contributes, moreover, to stable fastening of the illuminant.

According to a first version of the present invention the length of the side sections of the diffusion disc cover is chosen such that in the correctly arranged state the outer surface of the base section terminates substantially flush with the free end of the decorative arm of the profile. In this first version light emitted from the illuminant can accordingly only pass out of the profile in one direction.

According to a second version the first side section has in the region of its free end a region receding in the direction of the second side section and which is made such that in the correctly arranged state the outer surface of the protruding region of the first side section terminates substantially flush with the outer surface of the decorative arm of the profile. In this second version the light can accordingly also leave the profile in a second direction, as described in more detail by means of the exemplary embodiment described below.

Preferably, in order to fix the diffusion disc cover to the profile fastening means are provided which are made integrally with the profile and the diffusion disc cover, by means of which an inexpensive structure with only a few individual components is achieved.

According to one configuration of the present invention the fastening means define a manually releaseable snap-on connection and are provided in particular in the form of protrusions and recesses engaging with one another. In this way a very simple structure of the fastening means is achieved.

The illuminant is advantageously elongate in form, in particular in the form of a strip or a chain with a plurality of LEDs arranged over the latter.

BRIEF DESCRIPTION OF THE DRAWINGS

Further features and advantages of the present invention are described by means of the following description of an illumination system according to an embodiment of the present invention with reference to the attached drawings. These show as follows.

DETAILED DESCRIPTION OF PREFERRED EMBODIMENTS

Figure 1:
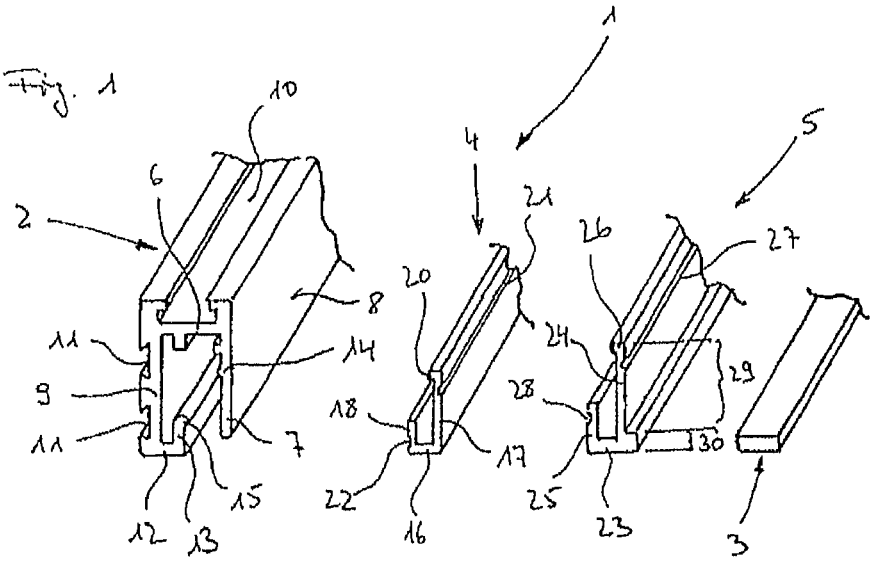
FIG. 1 a perspective view which shows the individual components of an illumination system according to an embodiment of the present invention.

FIG. 1 shows an illumination system 1 according to an embodiment of the present invention which serves to indirectly or directly illuminate the steps of a staircase. As its main components the illumination system 1 comprises a profile 2, an illuminant 3 and two types of diffusion disc cover 4, 5.

The profile 2 is an extruded profile that is preferably produced from aluminium or stainless steel, other materials basically also being able to be used, such as for example plastic or the like. The profile 2 comprises a base arm 6, a decorative arm 7 projecting from a free end of the base arm 6, the outer surface of which, in the correctly arranged state, forms a visible decorative surface 8, and a fastening arm 9 projecting from the other free end of the base arm 6, arranged lying opposite the decorative arm 7.

An undercut recess 10 is provided on the outside of the base arm 6. An adhesive that is used to fix the base arm 6 to a substrate can anchor in this undercut recess 10. Furthermore, a connection element can be positioned in the recess 10 in order to fasten adjacent profiles 2 to one another. Such connection elements are known from the prior art, and so they will not be discussed any further here. Similarly, two undercut recesses 11 which serve the same purpose are also formed on the outside of the fastening arm 9. Instead of the undercut recesses 10, 11, the base arm 6 and the fastening arm 9 can also be provided on the outside with a fleece or a fabric that serves as an adhesive base for a corresponding adhesive.

There is provided on the free end of the fastening arm 9 a limiting arm 12 projecting towards the decorative arm 7 which is adjoined by a holding arm 13 projecting towards the base arm 6 and which is positioned a distance away from the decorative arm 7. There is formed on the inside of the decorative arm 7 an inwardly projecting elongate protrusion 14 which together with a protrusion 15 positioned on the free end of the holding arm 13 and projecting towards the decorative arm 7 is used to hold the diffusion disc cover 4 or the diffusion disc cover 5, as described in more detail below.

Figure 2:
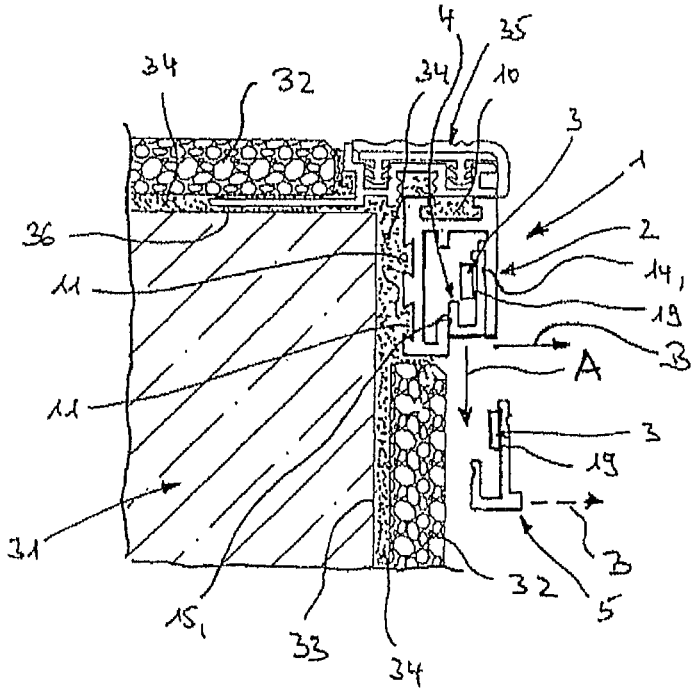
FIG. 2 a side view which shows the illumination system shown in FIG. 1 in the fitted state.

The diffusion disc cover 4 is produced from transparent plastic and comprises a base section 16 and two side sections 17, 18 projecting at right angles from the latter and arranged lying opposite one another. The first side section 17 is made longer than the second side section 18 and accommodates on its inside, in the region that projects over the second side section 18, the illuminant 3 that can be fixed, for example with an adhesive strip 19, a shown in FIG. 2. By virtue of the different lengths of the side sections 17, 18 the illuminant 3 is easily accessible for a user. In the region of the free end of the first side section 17 there is provided an inwardly pointing protrusion 20 which serves as a stop for the illuminant 3. Every side section 17, 18 is provided on its outside with a groove-shaped recess 21, 22, in the correctly arranged state the groove-shaped recesses 21, 22 co-operating with the elongate protrusions 14, 15 of the profile 2 and defining a manually releaseable snap-on connection, as shown in FIG. 2. Correspondingly, the diffusion disc cover 4, with the illuminant 3 held on the latter, can be inserted between the decorative arm 7 and the holding arm 13 of the profile 2 until the snap-on connection engages. If the diffusion disc cover 4 is inserted into the profile 2, the arrangement shown in FIG. 2 is produced in which the outside of the base section 16 of the diffusion disc cover 4 terminates substantially flush with the free end of the decorative arm 7 of the profile 2. Correspondingly, light emitted by the illuminant 3 can only leave the profile 2 in the direction of arrow A.

The diffusion disc cover 5 is also produced from transparent plastic and comprises a base section 23 and two side sections 24, 25 projecting at right angles from the latter and arranged lying opposite one another. The first side section 24 is made longer than the second section 25, the illuminant 3 being fastened by an adhesive strip 19 to the inside of the region of the first side section 24 which projects over the second side section 25. By virtue of the different lengths of the side sections 24, 25 the illuminant 3 is easily accessible for a user. In the region of the free end of the first side section 24 there is provided an inwardly pointing protrusion 26 that forms a stop for the illuminant 3. The side sections 24, 25 are respectively provided on their outside with a groove-shaped recess 27, 28 which in turn co-operate with the protrusions 14, 15 of the profile 2, thus forming a releaseable snap-on connection. The first side section 24 of the diffusion disc cover 5 has in the region of its free end a region 29 receding in the direction of the second side section 25 and which is made such that in the correctly arranged state the outer surface of the correspondingly protruding region 30 of the first side section 24 terminates substantially flush with the outer surface of the adjacently arranged decorative arm 7 of the profile 2. Correspondingly, light emitted from the luminant 3 can leave the profile 2 in the direction of arrows A and B.

The illuminant 3 is an elongate strip with a plurality of LEDs arranged over the latter. The way the light passes out of the illuminant 3 is chosen such that in the correctly arranged state light is emitted towards the base section 16, 23 of the corresponding diffusion disc cover 4, 5.

FIG. 2 shows the illumination system 1 in the fitted state in which it is used for indirectly or directly illuminating the steps of a staircase, a single step 31 being shown in FIG. 2. In the arrangement shown in FIG. 2, in a first step the tiles 32 of the abutting surface 33 of the step 31 are fastened by tile adhesive 34. In a further step the profile 2 of the illumination system 1 with the fastening arm 9 is then fitted to the abutting surface 33, likewise using tile adhesive 34, such that the limiting arm 12 rests against the tile 32 with an appropriate distance between the joints. A conventional step edging profile 35 is then fixed by means of tile adhesive 34 both to the tread 36 of the step 31 and to the base arm 6 of the profile 2 of the illumination system 1. Next further tiles 32 are fixed to the tread 36 by means of tile adhesive, said tiles covering the fastening arm of the step edging profile 35. The diffusion disc cover 4 or the diffusion disc cover 5 can now optionally be inserted into the profile 2 of the illumination system 1 with the illuminant 3 held in said cover. If light is only to be emitted in the direction of arrow A, the diffusion disc cover 4 is used. If light is to be emitted both in the direction of arrow A and in the direction of arrow B, the diffusion disc cover 5 is used. Correspondingly, either indirect illumination or both indirect and direct illumination of the step 31 is achieved. If the illumination system has to bear weight from above, the load is transferred by the limiting arm 12.

It is an advantage of the illumination system 1 shown in the figures that the illuminant 3, together with the diffusion disc cover 4 or 5, can be removed from the profile 2, whereupon the illuminant 3 is easily accessible. In this way a very maintenance-friendly structure is achieved. Furthermore, the space defined between the fastening arm 9 and the holding arm 13 can be used as a cable duct.

| LIST OF REFERENCE NUMBERS | |
|---|---|
| 1 | illumination system |
| 2 | profile |
| 3 | illuminant |
| 4 | diffusion disc cover |
| 5 | diffusion disc cover |
| 6 | base arm |
| 7 | decorative arm |
| 8 | decorative surface |
| 9 | fastening arm |
| 10 | recess |
| 11 | recess |
| 12 | limiting arm |
| 13 | holding arm |
| 14 | protrusion |
| 15 | protrusion |
| 16 | base section |
| 17 | side section |
| 18 | side section |
| 19 | adhesive strip |
| 20 | protrusion |
| 21 | groove-shaped recess |
| 22 | groove-shaped recess |
| 23 | base section |
| 24 | side section |
| 25 | side section |
| 26 | protrusion |
| 27 | groove-shaped recess |
| 28 | groove-shaped recess |
| 29 | receding region |
| 30 | protruding region |
| 31 | step |
| 32 | tile |
| 33 | abutting surface |
| 34 | tile adhesive |
| 35 | step edging profile |
| 36 | tread |
| A | arrow |
| B | arrow |

What is claimed is:

1. An illumination system (1) for indirectly or directly illuminating an outer edge arrangement of a structure covered in tiles, such as for example a step (31) of a staircase, comprising at least one elongate profile (2) that forms a base arm (6), a decorative arm (7) projecting from a free end of the base arm (6) and the outer surface of which forms a visible decorative surface (8) in the correctly arranged state, and a fastening arm (9) projecting from the other free end of the base arm (6), arranged opposite the decorative arm (7), wherein the fastening arm (9) is provided on its outside with at least one undercut recess (11), at least one illuminant (3) that is fastened or can be fastened within the receiving space defined by the base arm (6), the decorative arm (7) and the fastening arm (9), and at least one elongate diffusion disc cover (4, 5) that can be fixed to the profile (2).

2. The illumination system (1) according to claim 1, wherein the profile (2) is an extruded profile with a cross-section that remains the same over the entire length.

3. The illumination system (1) according to claim 1, wherein the profile (2) is produced from aluminium or stainless steel.

4. The illumination system (1) according to claim 1, wherein a fleece or a fabric is fastened to the outside of the fastening arm (9).

5. The illumination system (1) according to claim 1, wherein at least one undercut recess (10) is provided on the outside of the base arm (6).

6. The illumination system (1) according to claim 1, wherein a fleece or a fabric is fastened to the outside of the base arm (6).

7. The illumination system (1) according to claim 1, wherein a limiting arm (12) projecting towards the decorative arm (7) is provided on the free end of the fastening arm (9).

8. The illumination system (1) according to claim 7, wherein a holding arm (13) projecting towards the base arm (6) adjoins the limiting arm (12), said holding arm being positioned a distance away from the decorative arm (7).

9. The illumination system (1) according to claim 1, wherein the decorative arm (7) and the fastening arm (9) extend parallel to one another and respectively at an angle of 90° in relation to the base arm (6).

10. The illumination system (1) according to claim 1, wherein the diffusion disc cover (4, 5) is substantially U-shaped and has a base section (16; 23) and two side sections (17, 18; 24, 25) projecting from the latter and lying opposite one another.

11. The illumination system (1) according claim 10, wherein the first side section (17; 24) is made longer than the second side section (18; 25), in the correct state the illuminant (3) being positioned on the inner surface of the first side section (17; 24) in the region protruding with respect to the second side section (18; 25).

12. The illumination system (1) according to claim 11, wherein there is formed in the region of the free end of the first side section (17; 24) an inwardly projecting protrusion (20; 26) which serves as a stop for the illuminant (3).

13. The illumination system (1) according to claim 10, wherein the length of the side sections is chosen such that in the correctly arranged state the outer surface of the base section (16) terminates substantially flush with the free end of the decorative arm (7) of the profile (2).

14. The illumination system (1) according to claim 10, wherein the first side section (24) has in the region of its free end a region (29) receding in the direction of the second side section (25) which is made such that in the correctly arranged state the outer surface of the protruding region (30) of the first side section (24) terminates substantially flush with the outer surface of the decorative arm (7) of the profile (2).

15. The illumination system (1) according to claim 1, wherein, in order to fix the diffusion disc cover (4, 5) to the profile (2) fastening means are provided which are made integrally with the profile (2) and the diffusion disc cover (4, 5).

16. The illumination system (1) according to claim 15, wherein the fastening means define a manually releaseable snap-on connection and are provided in particular in the form of protrusions (14, 15) and recesses (21, 22; 27, 28) engaging with one another.

17. The illumination system (1) according to claim 1, wherein the illuminant (3) is elongate in form, in particular in the form of a strip or a chain with a plurality of LEDs arranged over the latter.

18. An illumination system (1) for indirectly or directly illuminating an outer edge arrangement of a structure covered in tiles, such as for example a step (31) of a staircase, comprising at least one elongate profile (2) that forms a base arm (6), a decorative arm (7) projecting from a free end of the base arm (6) and the outer surface of which forms a visible decorative surface (8) in the correctly arranged state, and a fastening arm (9) projecting from the other free end of the base arm (6), arranged opposite the decorative arm (7), wherein a fleece or a fabric is fastened to an outside of the fastening arm (9), at least one illuminant (3) that is fastened or can be fastened within the receiving space defined by the base arm (6), the decorative arm (7) and the fastening arm (9), and at least one elongate diffusion disc cover (4, 5) that can be fixed to the profile (2).

* * * * *